US012048886B2

(12) United States Patent
Chan et al.

(10) Patent No.: US 12,048,886 B2
(45) Date of Patent: Jul. 30, 2024

(54) TOY FIGURINE AND/OR TOY THAT PRESENTS SUBSTANTIALLY RANDOM PRESELECTED INFORMATION

(71) Applicant: Mattel, Inc., El Segundo, CA (US)

(72) Inventors: Patricia Chan, Redondo Beach, CA (US); James Molina, Westminster, CA (US); Kelley Lindberg, Lakeway, TX (US); Todd Gionet, Fountain Valley, CA (US)

(73) Assignee: MATTEL, INC., El Segundo, CA (US)

( * ) Notice: Subject to any disclaimer, the term of this patent is extended or adjusted under 35 U.S.C. 154(b) by 280 days.

(21) Appl. No.: 17/582,269

(22) Filed: Jan. 24, 2022

(65) Prior Publication Data

US 2023/0233951 A1 Jul. 27, 2023

(51) Int. Cl.

| | |
|---|---|
| ***A63H 3/36*** | (2006.01) |
| ***A63F 9/04*** | (2006.01) |
| ***A63H 3/00*** | (2006.01) |

(52) U.S. Cl.

CPC ..... *A63H 3/003* (2013.01); *A63F 9/0406* (2013.01); *A63F 9/0415* (2013.01); *A63F 2009/0464* (2013.01); *A63F 2009/0473* (2013.01); *A63F 2009/0484* (2013.01); *A63F 2250/04* (2013.01)

(58) Field of Classification Search

CPC ..... A63H 3/003; A63H 33/00; A63F 9/0406; A63F 9/0415; A63F 2009/0431; A63F 2009/0473; A63F 2009/0484; A63F 2009/0486; A63F 2009/0488; A63F 2250/04

USPC ..... 273/145 R, 145 C, 146, 161, 457; 446/268

See application file for complete search history.

(56) References Cited

U.S. PATENT DOCUMENTS

| | | | | | |
|---|---|---|---|---|---|
| 484,115 | A * | 10/1892 | Saxton | A63F 9/0406 | 273/145 C |
| 1,538,455 | A * | 5/1925 | Winkel | A63F 9/0406 | 273/145 C |
| 1,592,813 | A * | 7/1926 | Whitney | A63F 9/0406 | 273/145 C |
| 2,452,730 | A * | 11/1948 | Carter | A63F 9/0406 | 273/145 C |
| 3,119,621 | A * | 1/1964 | Bookman | A63F 9/0406 | 273/145 C |
| 3,168,315 | A * | 2/1965 | Bookman | A63H 33/00 | D11/131 |
| 4,049,277 | A * | 9/1977 | Carlsson, Jr. | A63F 9/0406 | 273/145 C |
| 4,148,488 | A * | 4/1979 | Kohlhagen | A63F 9/04 | 273/146 |
| 4,632,397 | A * | 12/1986 | Rivkin | A63F 9/0406 | 273/145 CA |
| 5,022,654 | A * | 6/1991 | Berger | A63F 9/0406 | 273/145 CA |
| 6,755,416 | B2 * | 6/2004 | Nakamoto | A63F 9/0406 | 273/145 A |

(Continued)

*Primary Examiner* — Alexander R Niconovich

(74) *Attorney, Agent, or Firm* — Edell, Shapiro & Finnan, LLC

(57) ABSTRACT

A toy figurine and/or toy includes a body portion having an internal cavity, a substantially transparent portal through which contents of the internal cavity are viewable, and a die. The internal cavity includes a fluid and the die is freely floating in the fluid, and the die includes a plurality of faces. Each of these faces includes a visual element.

20 Claims, 9 Drawing Sheets

(56) References Cited

U.S. PATENT DOCUMENTS

| | | | | |
|---|---|---|---|---|
| 10,463,952 | B2 * | 11/2019 | Read | A63F 9/0468 |
| 2006/0171512 | A1 * | 8/2006 | Staudenmeier | A63F 3/001<br>379/82 |
| 2008/0032591 | A1 * | 2/2008 | Cullen | A63H 3/00<br>446/297 |
| 2010/0181719 | A1 * | 7/2010 | Kessler | A63F 9/0406<br>273/161 |
| 2022/0088471 | A1 * | 3/2022 | Sershon | A63H 3/16 |

* cited by examiner

TOY FIGURINE AND/OR TOY THAT PRESENTS SUBSTANTIALLY RANDOM PRESELECTED INFORMATION

FIELD OF THE INVENTION

The present application relates generally to toys such as dolls or figurines and, in particular, to toys such as dolls or figurines that can be used for fortune-telling and/or other playtime activities that require a source of substantially random preselected information.

BACKGROUND

Through the years, toy dolls and/or figurines (for simplicity, referred to herein as figurines or toy figurines) have provided amusement and entertainment for children. That is, toy dolls and figurines have some inherent play value. To increase this play value, various features, such as actions, movements, or other functions, have been incorporated into some figurines (e.g., so that figurines can appear to walk, crawl, talk, be incorporated into board games, etc.).

Some toys may entertain users by providing pseudo-random output of preselected information. As one example, U.S. Pat. No. 3,119,621, which is issued to Abe C. Bookman. and entitled LIQUID FILLED DIE AGITATOR CONTAINING A DIE HAVING RAISED INDICIA ON THE FACETS THEREOF, discloses a "Magic 8-Ball" that is a sphere, made to look like a billiard ball, that is filled with a liquid and includes a die having words on each face that can be used to answer yes-or-no questions. Thus, a user can shake the sphere and observe the die through a transparent panel to read an answer to a posed question, such as "yes," "no," "outlook not so good," and the like.

Despite the foregoing, there is a continuing need for more interesting and varied toy or doll features, for example, to entertain a child. In particular, while the features of U.S. Pat. No. 3,119,621 may be interesting and engage a user, the billiard-ball appearance may fail to entertain a user in various contexts, and a child may quickly become bored with such a toy.

SUMMARY

A toy figurine and/or a toy are presented herein. In at least some embodiments, the toy includes a body portion in which a substantially transparent portal is provided to view an internal cavity. The internal cavity may be filled with a fluid and a die may freely float in the fluid. The die may include a plurality of faces, each including a visual element, so that when the toy is agitated, a particular face of the die may be viewable through the portal.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy figurine and/or toy presented herein may be better understood with reference to the following drawings and description. The elements in the figures are not necessarily to scale, emphasis instead being placed upon illustrating the principles of the toy figurine. In the figures, like-referenced numerals designate corresponding parts throughout the different views.

DETAILED DESCRIPTION

The toy figurine and/or the toy presented herein includes an interior cavity in which a fluid is provided to support a free-floating die in the fluid. A viewing portal composed of a semi-transparent or substantially transparent material is also provided in the body of the toy figurine or toy so that a user can view the die floating in the fluid. The die may include a plurality of faces that each have a different visual element, such as a word, phrase, icon, symbol, color, and the like. In at least some embodiments, as a user engages with the toy figurine or toy, the contents of the interior cavity are mechanically agitated such that the various faces of the die are visible to the user. Due to the mechanical agitation, the user may not be able to predict which particular face is visible through the portal at a given time, thus enabling the toy figurine or toy to act as a source of substantially random selection, which can be used to support a variety of tasks. For example, a user can ask the toy figurine or toy questions, and the visual element of the face exposed through the portal can be interpreted as an answer. Thus, present embodiments increase play value beyond the value already provided by a conventional toy or figurine by further providing a source of substantially random, preselected information.

Figure 1:
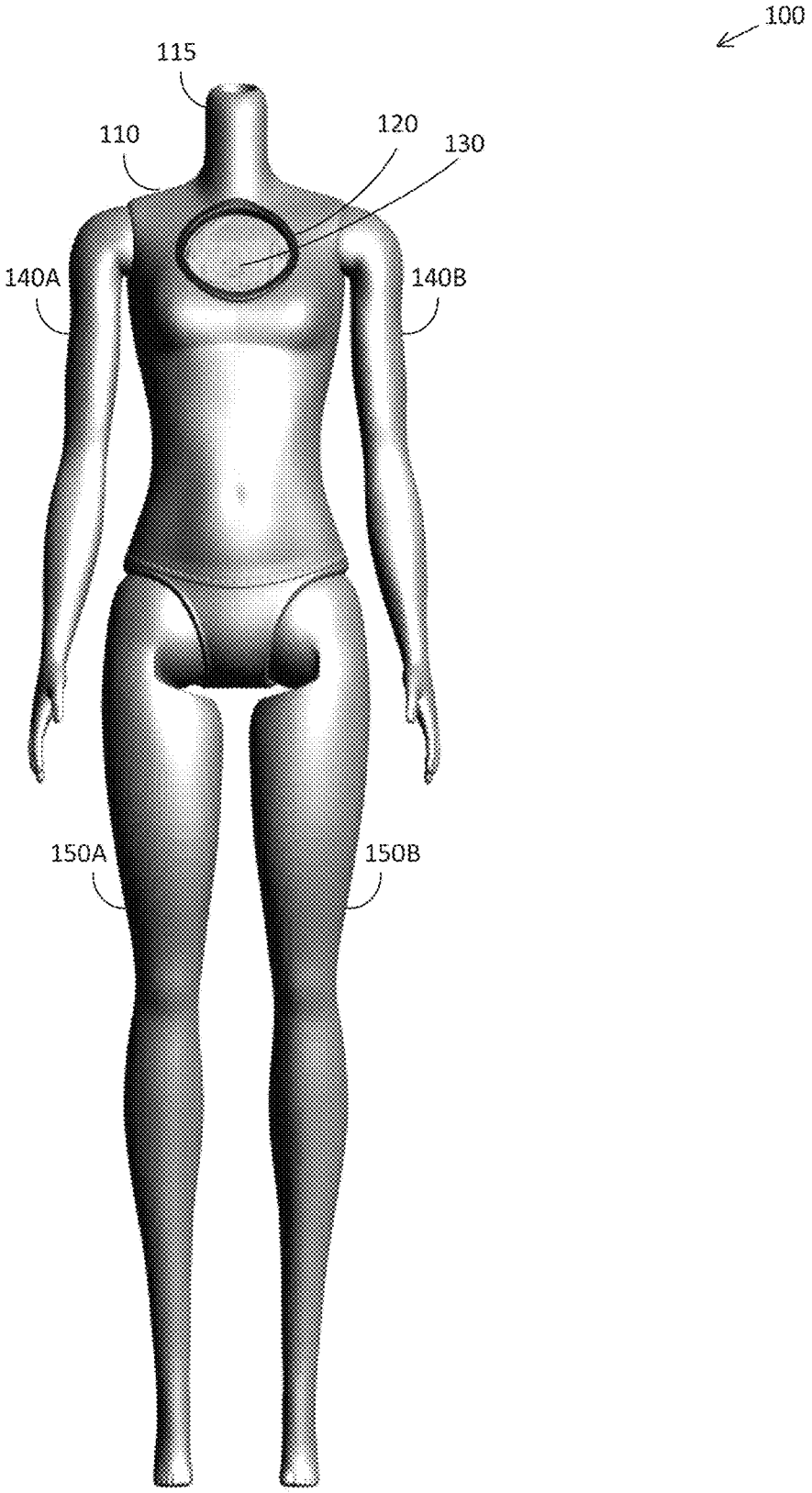
FIG. 1 illustrates a front view of an example embodiment of a toy figurine with a portal for viewing a die freely floating in a fluid.

FIG. 1 illustrates a front view of an example embodiment of a toy figurine 100 having a body portion 110 with a neck portion 115 and a portal 120 for viewing a die 130 freely floating in a fluid. As depicted, toy figurine 100 is a humanoid figurine that includes a right arm 140A, left arm 140B, right leg 150A, and left leg 150B each attached to body portion 110. It should be appreciated that in various other embodiments, the toy may not be a humanoid figurine, but may instead be incorporated into another toy, such as a toy vehicle, a toy animal, etc. In the depicted embodiment, there is no head portion, but it should be appreciated that a variety of head portions can be provided that are attachable to neck portion 115 in accordance with various embodiments to achieve any desired aesthetic or entertainment goal.

In the depicted embodiment, arms 140A, 140B and legs 150A, 150B articulate at various joints with respect to body portion 110 so that toy figurine 100 can be manipulated into a variety of poses or other configurations. The joints are provided at attachment points between body portion 110 and arms 140A, 140B and legs 150A, 150B, and may include ball-and-socket or other joints. Additionally or alternatively, joints may be provided at locations corresponding to elbows, knees, ankles, and/or wrists of toy figurine 100. Again, these joints may be constructed in any manner. Likewise, the various appendages (e.g., arm 140A, arm 140B, leg 150A, and/or leg 150B) can be formed from any number of parts in any desirable manner (e.g., by coupling clamshell portions together).

As depicted, the portal 120 included in the body portion 110 of the toy figurine 100 is substantially transparent to enable a user to view an internal cavity provided in body portion 110. In some embodiments, the internal cavity houses a chamber that is inserted in body portion, as is depicted and discussed in further detail with respect to FIGS. 5-7 and 12. Alternatively, the body portion 110 may define a chamber (i.e., the chamber may be integrally formed with the body portion 110). Either way, the body portion 110 serves as a housing for the chamber and the portal 120 provides a window through which a user can view the contents of the chamber.

The internal cavity of toy figurine 100 is partially or substantially filled with a fluid in which die 130 freely floats. When a user holds toy figurine substantially 100 upright (e.g., with the body portion 110 above legs 150A, 150B such that toy figurine 100 is parallel with respect to a gravitational force), a buoyant property of die 130 causes die 130 to float proximal to portal 120. Thus, one or more faces of die 130 becomes visible to a user through portal 120. Accordingly, portal 120 includes a substantially transparent or semi-transparent material, such as a glass, acrylic, polyethylene terephthalate (PET), polypropylene, polystyrene, and the like.

When toy figurine 100 is tilted (e.g., moved in a direction partially or substantially orthogonal to a gravitational force), the die 130 floats throughout the internal cavity. While die 130 is floating, die 130 may rotate throughout the fluid provided in the internal cavity such that when toy figurine 100 is held upright again, die 130 presents a same or different face when die 130 floats to be proximal to portal 120. Mechanical agitation during the tilting process, typically provided by a user, causes the face that is presented to portal 120 to be substantially random each time, similar to rolling a die, so that a same or different face of die 130 is presented after each tilting session. Accordingly, toy figurine 100 can be manipulated by a user to view various faces of die 130 in a manner that unpredictably presents the various faces. Thus, toy figurine 100 can be used for a variety of applications, such as providing answers to questions posed by a user or providing other feedback. In some embodiments, the feedback provided by die 130 of toy figurine 100 can be used to support various playtime activities, such as board games, or other games in which the rules require a substantially random source of preselected information.

Figure 2:
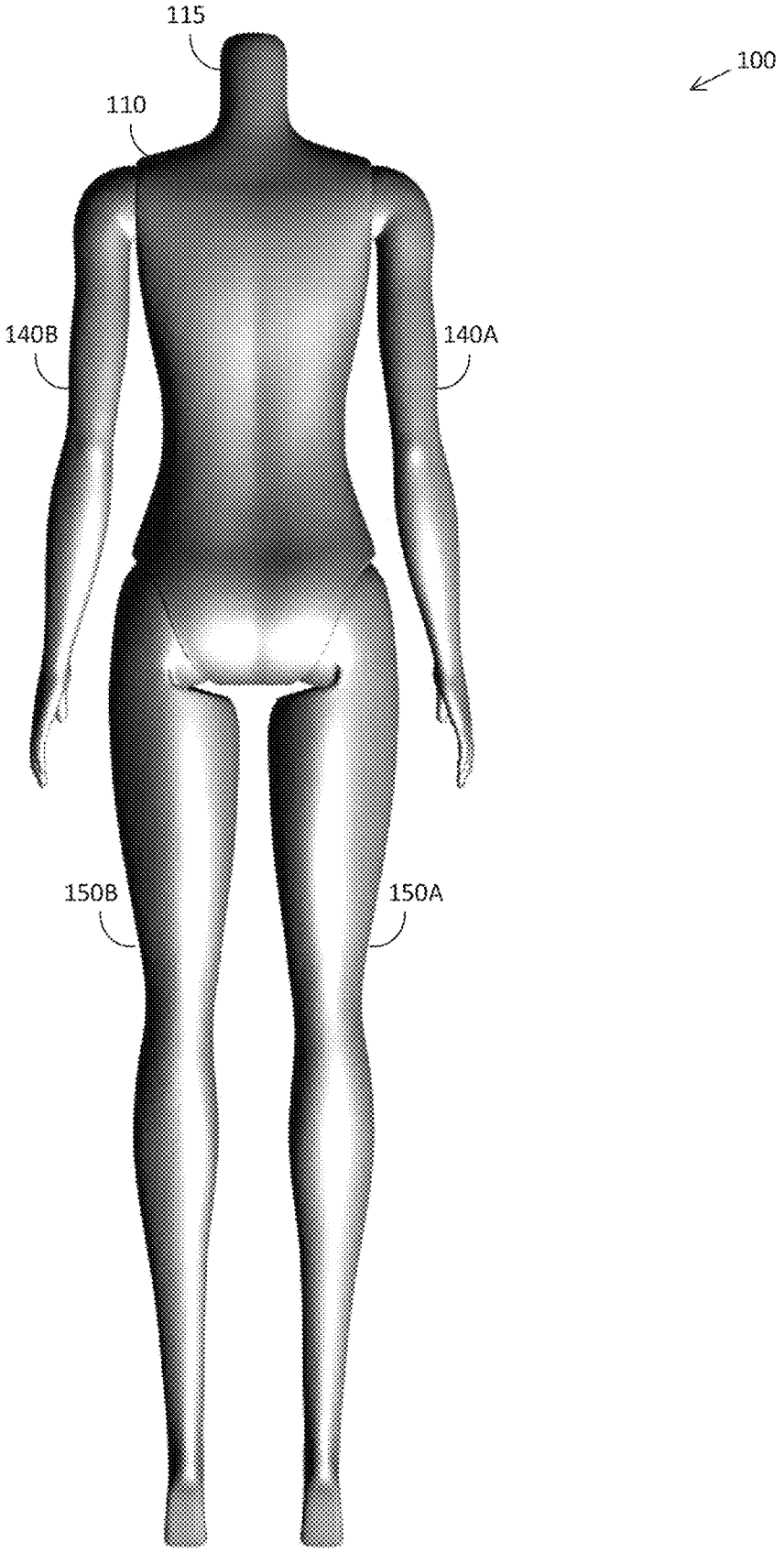
FIG. 2 illustrates a back view of the toy figurine of FIG. 1 in accordance with an example embodiment.

FIG. 2 illustrates a back view of the toy figurine 100 of FIG. 1 in accordance with an example embodiment. As shown, the posterior of the toy figurine is defined by rear portions of the body portion 110, neck portion 115, arms 140A and 140B, and legs 150A and 150B. Although the embodiments depicted in FIGS. 1 and 2 include portal 120 on the anterior of toy figurine 100, it should be appreciated that portal 120 can be positioned on other portions of toy figurine 100, such as the posterior. In various embodiments, toy figurine 100 may additionally include clothing and/or other apparel, as well as items such as jewelry, accessories, and the like. Any clothing may include an opening configured to align with the portal 120, regardless of whether the portal 120 is disposed on the anterior of the toy figurine 100, the posterior of the toy figurine 100, or on any other location of a toy figurine or toy.

Figure 3:
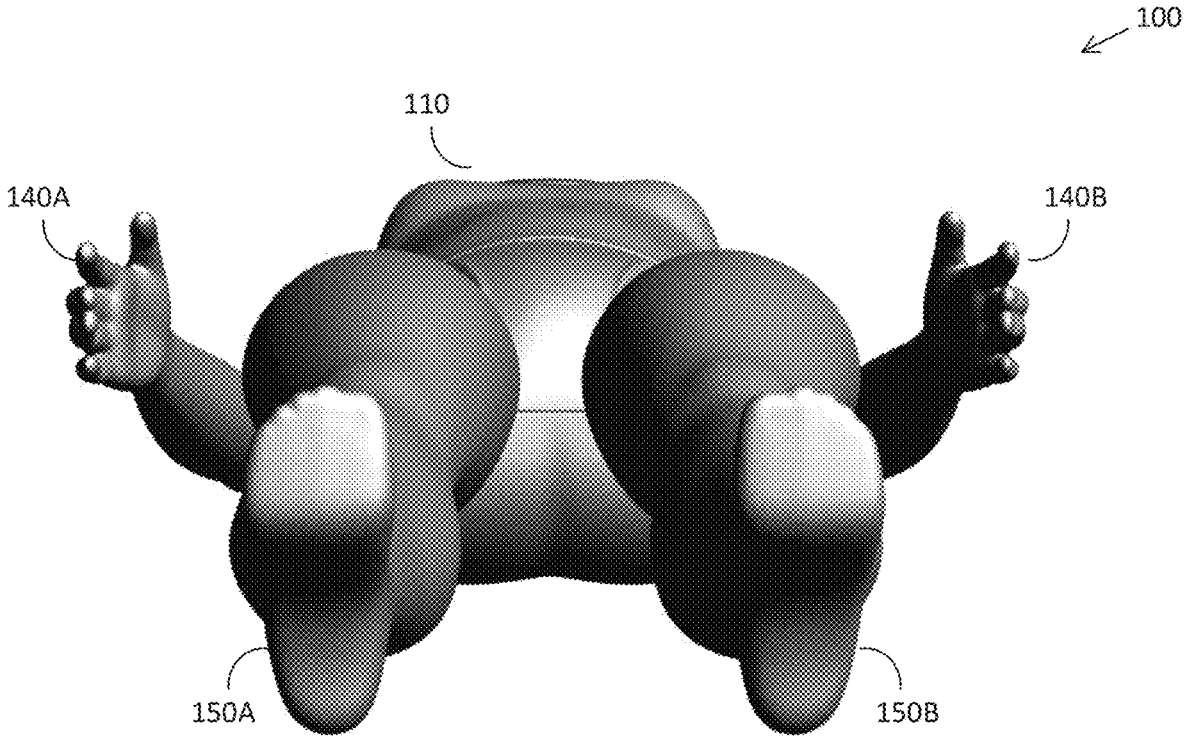
FIG. 3 illustrates a bottom view of the toy figurine of FIG. 1 in accordance with an example embodiment.
Figure 4:
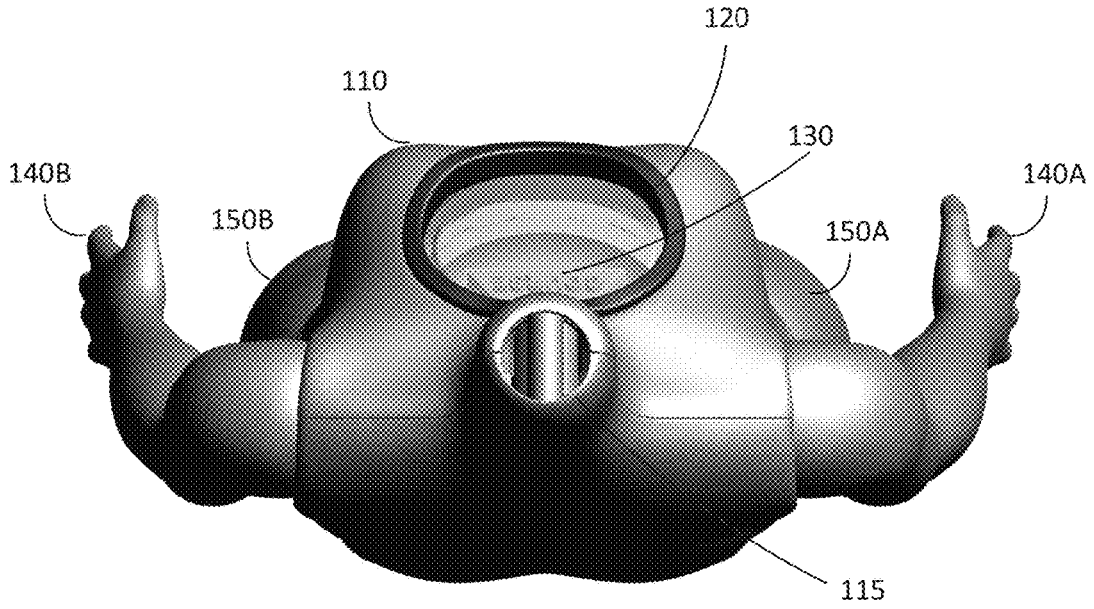
FIG. 4 illustrates a top view of the toy figurine of FIG. 1 in accordance with an example embodiment.

FIG. 3 illustrates a bottom view of the toy figurine 100 of FIG. 1 in accordance with an example embodiment, and FIG. 4 illustrates a top view of the toy figurine 100 of FIG. 1 in accordance with an example embodiment. As shown in FIGS. 3 and 4, toy figurine 100 includes body portion 110, arms 140A and 140B, and legs 150A and 150B. FIG. 4 further depicts neck portion 115 and portal 120 with die 130 visible through portal 120. Notably, in the depicted embodiment, the portal 120 is at least partially visible from above the toy figurine 100. That is, a user may have one or more lines of sight into the portal from above the toy figurine 100 and/or from a head location of the toy figurine 100. This ensures that the portal 120 is visible during common play patterns where a child holds a toy figurine's face proximate to their face.

Figure 5:
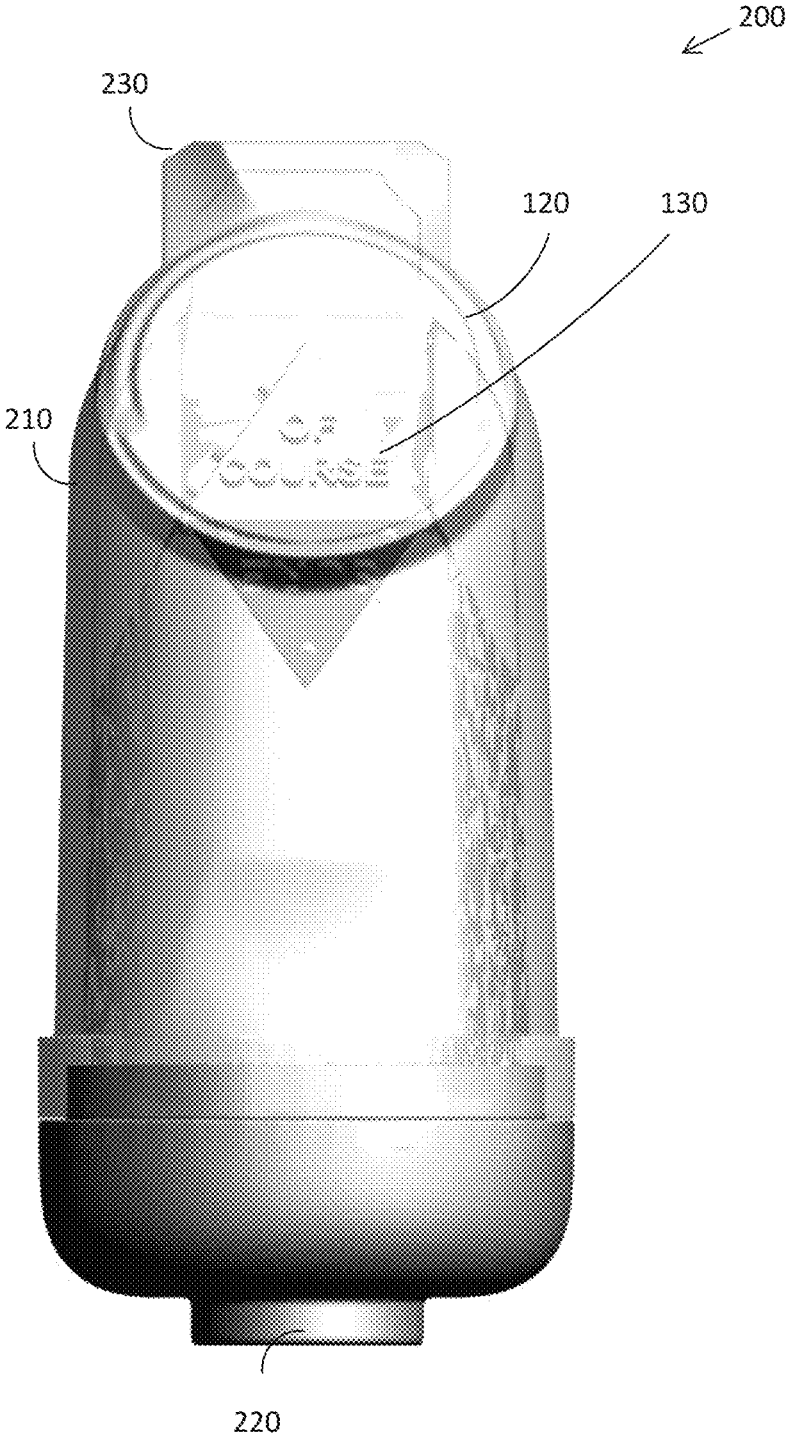
FIG. 5 illustrates a front view of an internal chamber for a toy figurine in accordance with an example embodiment.
Figure 6:
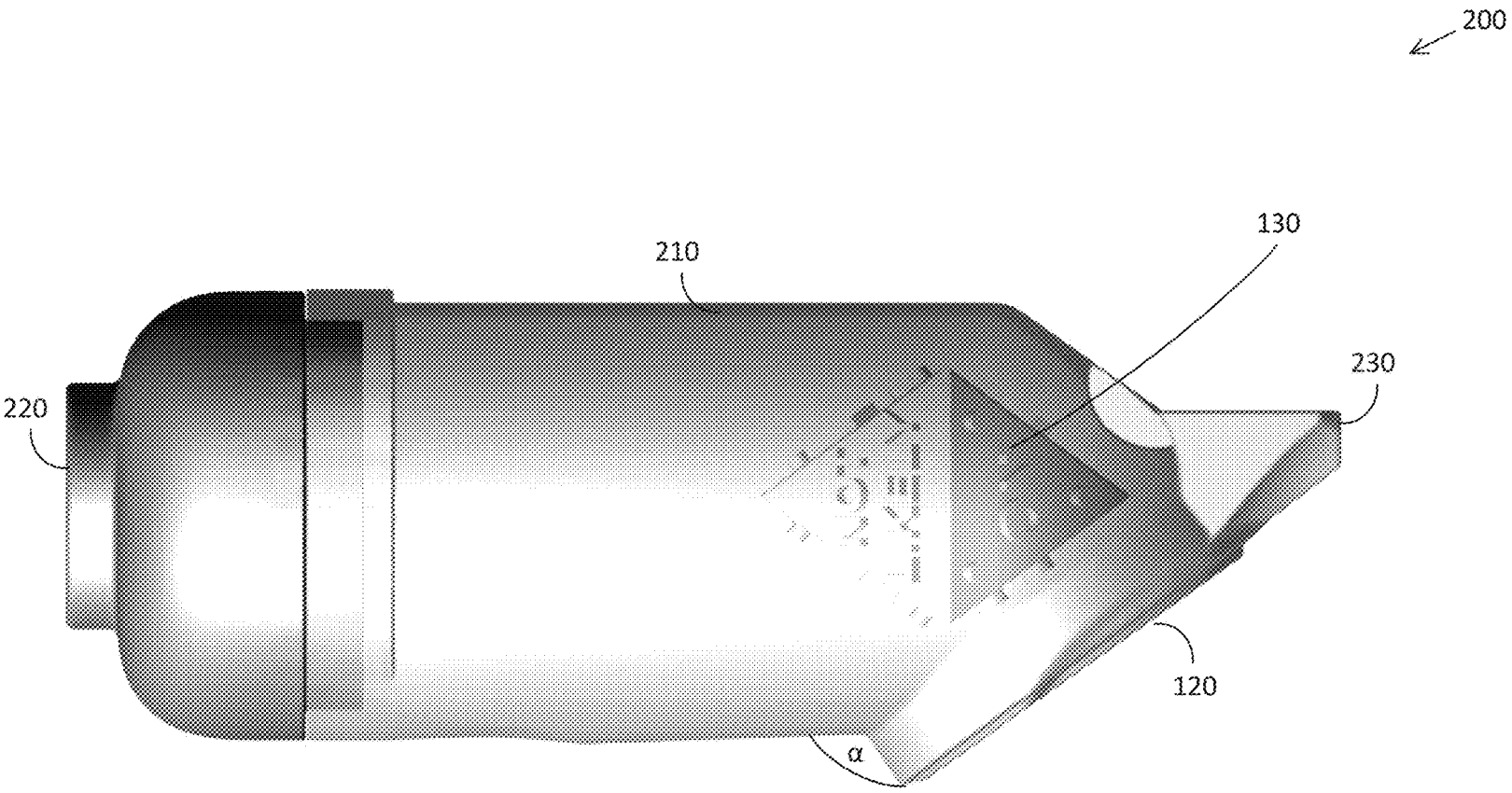
FIG. 6 illustrates a side view of a right side of the internal chamber of FIG. 5 in accordance with an example embodiment.
Figure 7:
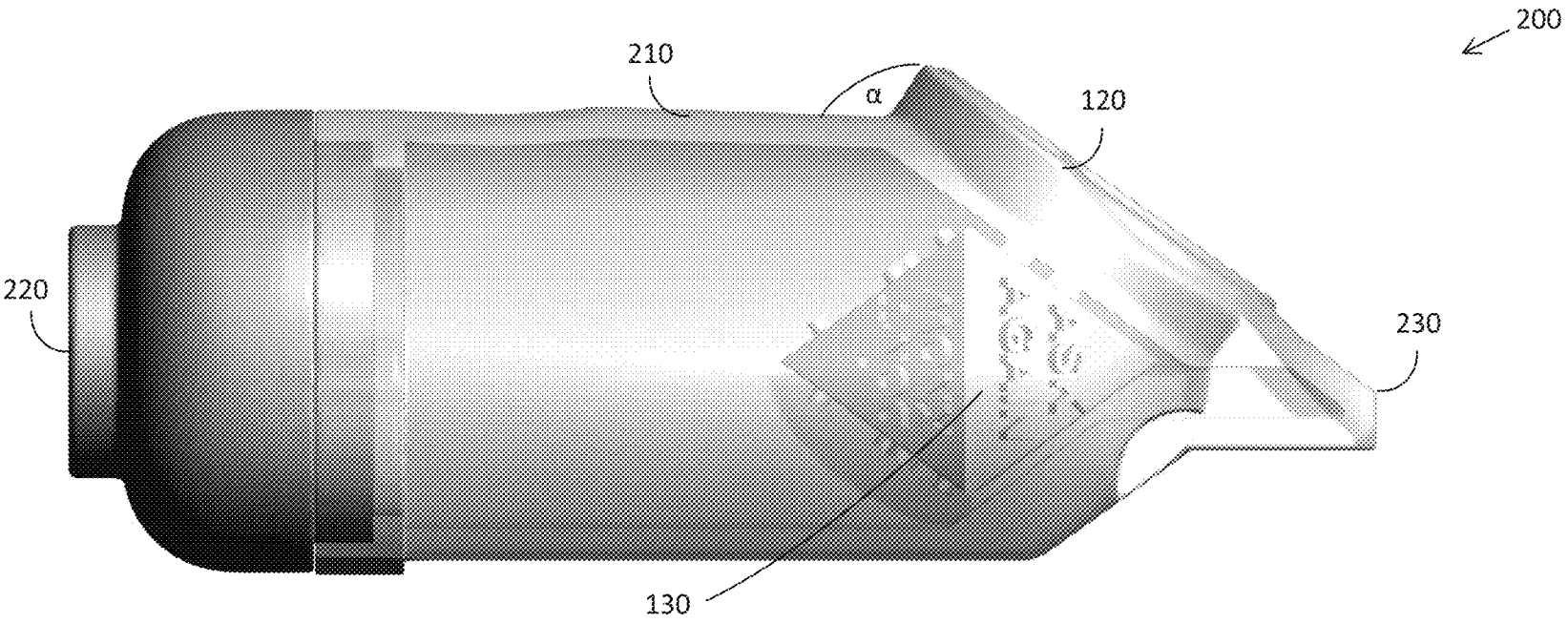
FIG. 7 illustrates a side view of a left side of the internal chamber of FIG. 5 in accordance with an example embodiment.

FIGS. 5-7 illustrate front, first side, and second side views, respectively, of an internal chamber 200 for a toy figurine in accordance with an example embodiment. Chamber 200 may be inserted into body portion 110 to form an assembly comprising toy figurine 100. As depicted, chamber 200 includes a chamber body 210, a cap portion 220, a tip portion 230, and portal 120. Chamber 200 is filled with a fluid that enables die 130 to float freely throughout the interior of chamber 200.

In at least some embodiments, the fluid and die 130 are provided in chamber body 210 prior to joining cap portion 220 to chamber body 210. In various embodiments, any conventional or other attachment mechanism may be employed; for example, the bottom of chamber body 210 may be threaded, and cap portion 220 may include complimentary threading so that cap portion 220 can be screwably affixed to chamber body 210 to secure the contents of chamber 200 (e.g., fluid and die 130). In some embodiments, cap portion 220 is permanently joined to chamber body 210, such that destructive removal is necessary (e.g., via ultrasonic welding). A seal (e.g., o-ring, gasket, etc.) may be provided between chamber body 210 and cap portion 220 so that fluid cannot escape from the interior of chamber 200. Additionally or alternatively, in some embodiments, the chamber body 210 is joined to the cap portion 220 in any of the foregoing manners and includes or define one or more fill ports (or other similar structures) that allows fluid to be introduced into a chamber defined by the chamber body 210 and the cap portion 220.

Tip portion 230 of chamber 200 is hollow to provide a bubble containment area so that any air bubbles in the fluid of chamber 200 will not be visible through portal 120 when toy figurine 100 is held in an upright position. In some embodiments, tip portion 230 of chamber 200 is narrower than chamber body 210 to facilitate insertion of chamber 200 into body portion 110 of toy figurine 100. Thus, tip portion 230 acts as a wedge to separate the interior material of body portion 110 in order to facilitate passage of chamber 200 through material of body portion 110. Additionally or alternatively, tip portion 230 acts as a stabilizer to reduce movement of chamber 200 inside of body portion 110, so that chamber 200 may more effectively remain in a desired location. In some embodiments, body portion 110 (and/or other portions of toy figurine 100) are formed (e.g., deposited) around chamber 200 via a process such as injection molding.

Referring still to FIG. 5, the interior geometry of chamber 200 is provided such that die 130, which is subject to a buoyant force in the fluid, floats upward toward portal 120 when toy figurine 100 is held in an upright position. In some embodiments, the interior surface of chamber 200 has ramped or sloped sides such that the cross-sectional area of the internal cavity narrows closer to portal 120 and the cross-sectional area is larger towards the opposite end (e.g., in the direction of cap portion 220). Thus, chamber 200 provides an interior cavity in which die 130 can rotate easily when toy figurine 100 is tilted, as die 130 may float freely in the larger cross-sectional area of the interior cavity. Then, when toy figurine 100 is held upright, die 130 floats upwardly and, due to the narrowing of the interior cavity, the die 130 is constricted towards portal 120.

Now turning to FIGS. 6 and 7, the material of chamber body 210 may be substantially transparent or semi-transparent, as is depicted, or just portal 120 may be substantially transparent or semi-transparent. In the depicted embodiment, portal 120 is tilted at an angle $\alpha$ such that portal 120, and therefore die 130, is more easily viewed by a user when toy figurine 100 is held upright. In the depicted embodiment, angle $\alpha$ is an obtuse angle between 90° and 180°. However, in other embodiments, the angle $\alpha$ may be a right angle or an acute angle (e.g., to angle the portal downwards).

Figure 8:
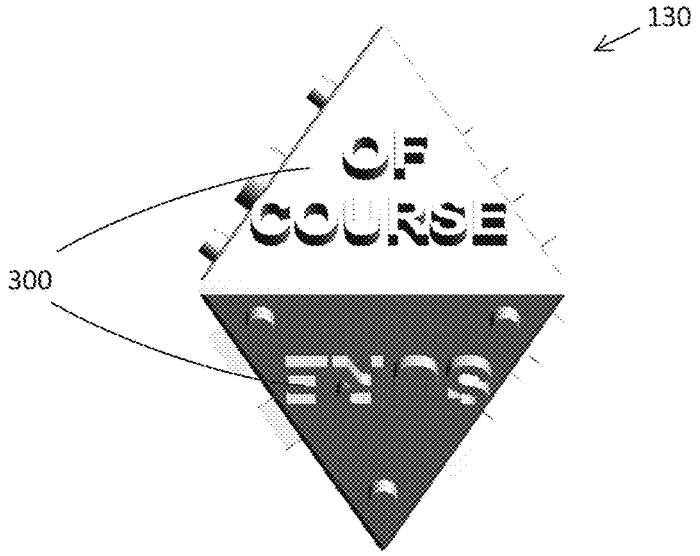
FIG. 8 illustrates a side view of a die in accordance with an example embodiment.
Figure 9:
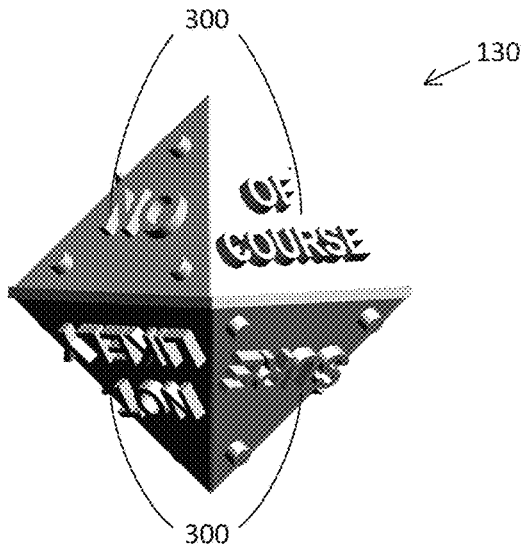
FIG. 9 illustrates a perspective view of the die of FIG. 8 in accordance with an example embodiment.
Figure 10:
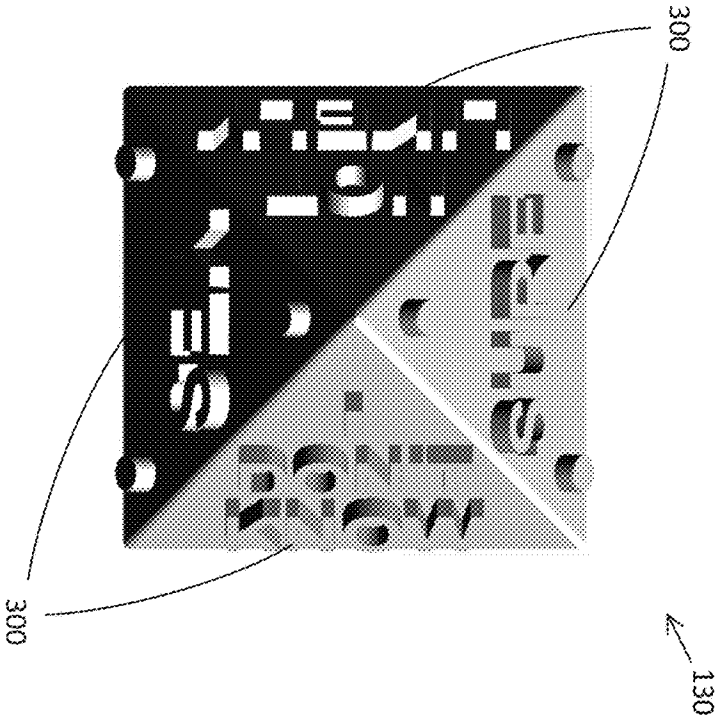
FIG. 10 illustrates a top view of the die of FIG. 8 in accordance with an example embodiment.
Figure 11:
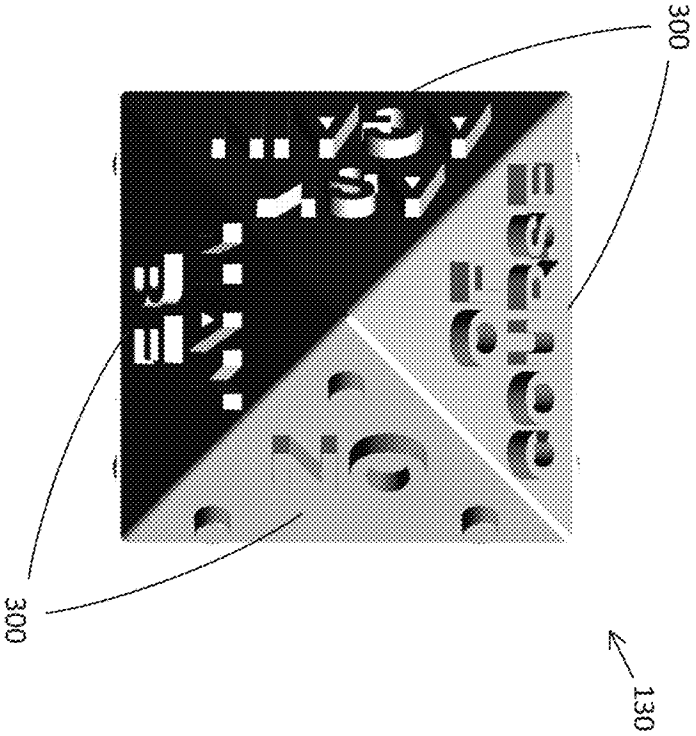
FIG. 11 illustrates a bottom view of the die of FIG. 8 in accordance with an example embodiment.

FIG. 8 illustrates a side view of a die 130 in accordance with an example embodiment, and FIG. 9 illustrates a view in perspective of a die 130 in accordance with an example embodiment. Similarly, FIG. 10 illustrates a top view of a die 130 in accordance with an example embodiment, and FIG. 11 illustrates a bottom view of a die 130 in accordance with an example embodiment. In the example embodiments depicted in FIGS. 8-11, die 130 is an octohedron to give die 130 a shape that facilitates die 130 in positioning at portal 120 when toy figurine 100 is placed in an upright position. In particular, the shape of die 130 forces die 130 to move adjacent to portal 120 such that the long axis of die 130 aligns with the gravitational force when the toy figurine 100 is held substantially upright; thus, any words, phrases, etc., that are printed on a face of die 130 can be presented in a right-side-up manner when toy figurine 100 is held upright. In various embodiments, die 130 may include any regular or irregular three-dimensional shape, such as an isohedron, polyhedron, and/or a rectangular (e.g., square) bipyramid having a first axis that is longer than a second axis.

As shown in FIGS. 8-11, die 130 includes a plurality of visual elements 300, with a particular visual element provided on each face of die 130. In some embodiments, the visual elements include a series of phrases, such as phrases that can serve as answers to yes-or-no questions. For example, die 130 may include visual elements like "yes," "no," "of course," "not likely," "sure," "maybe," "ask again," "don't know," and the like. Alternatively, in some embodiments, each face of die 130 includes a number or a color. For example, a number may include an Arabic numeral, a Roman numeral, or may be represented as one or more pips (e.g., as numbers are represented on a domino tile). In some embodiments, the visual elements include pictograms, pictures, symbols, Unicode characters such as emojis (e.g., "U+1F600" through "U+1F64F") or other characters, and the like.

Die 130 may be made of any material or combination of materials in order to make die 130 buoyant in a fluid that is provided to the interior cavity of chamber 200. In various embodiments, die 130 may be hollow or solid, wherein the density of die 130 is lower than the density of the surrounding fluid. In various embodiments, the fluid may include any conventional or other fluid, such as water, a water-based solution, an alcohol, or any other fluid. In some embodiments, the fluid includes a non-toxic fluid. In some embodiments, the fluid includes an antimicrobial or antifungal property. In some embodiments, a dye is provided to the fluid that is at least partially soluble in the fluid. In one example embodiment, the fluid in which die 130 is floating within includes an alcohol with a blue dye.

Figure 12:
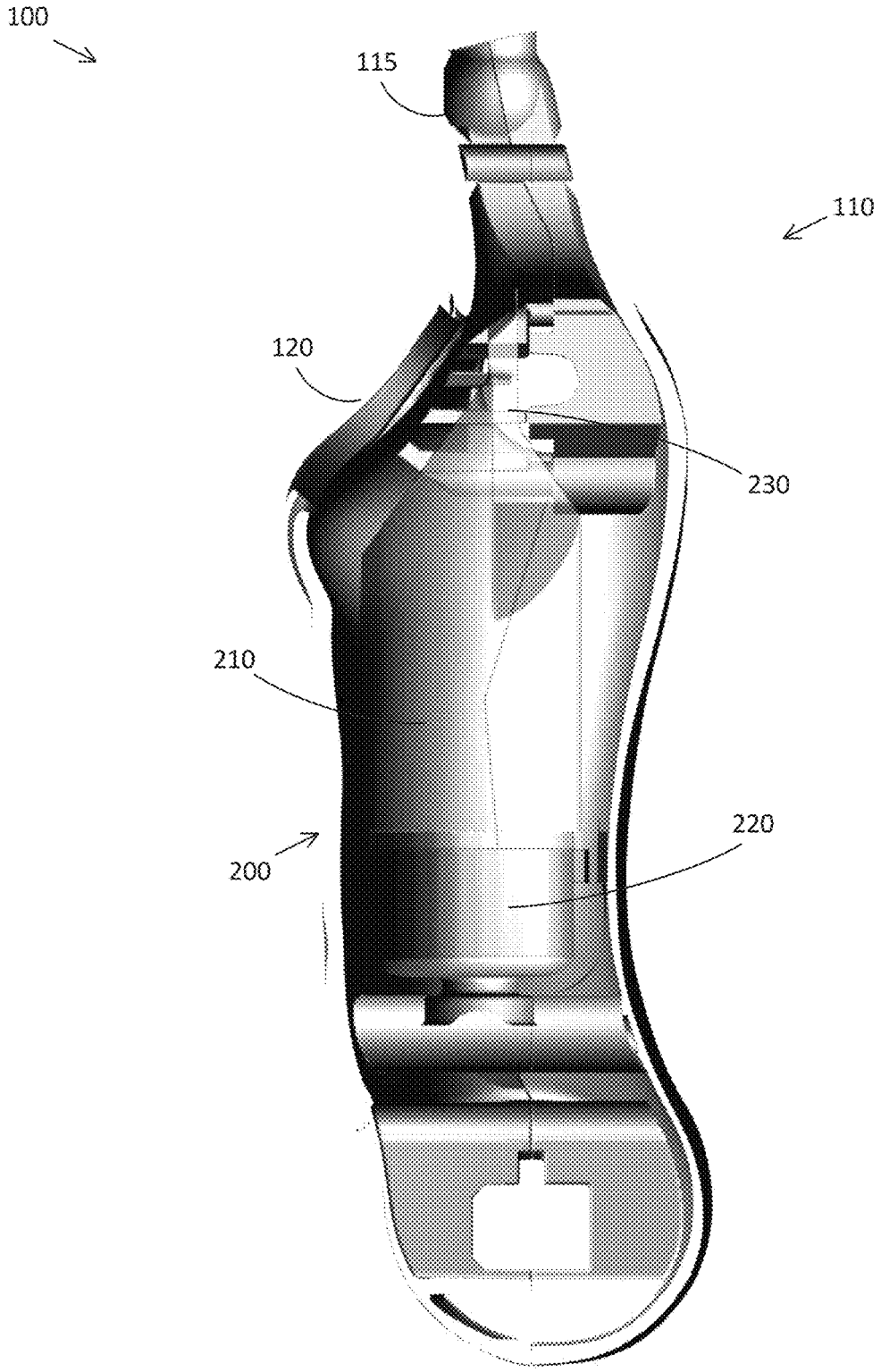
FIG. 12 illustrates a sectional view of a body portion of a toy figurine in which a chamber may be inserted in accordance with an example embodiment.

FIG. 12 illustrates a sectional view of a body portion 110 of a toy figurine 100 in which a chamber 200 is inserted in accordance with an example embodiment. As shown in the example embodiment of FIG. 12, chamber 200 is inserted into body portion 110 such that tip portion 230 of chamber 200 is oriented towards neck portion 115 of body portion 110, and cap portion 220 is in the opposite direction. Accordingly, portal 120 is presented through body portion 110 and the die 130 is biased towards portal 120 to be viewable to a user when body portion 110 of toy figurine 100 is held in an upright position.

Moreover, when tip portion 230 of chamber 200 is disposed in the neck portion 115 of body portion 110 and cap portion 220 is disposed proximate a hip section of body portion 110, the body portion may provide two points of engagement for chamber 200. These two points of engagement ensure chamber 200 is fixedly secured within body portion 110, even during agitation of toy figurine 100 that is naturally encouraged by inclusion of chamber 200. In fact, in some embodiments, tip portion 230 and cap portion 220 may each be coupled to corresponding structures included on an interior surface of body portion 110, e.g., with any combination of snap fits, interference fits, one or more couplers (e.g., screws), etc. However, to be clear, FIG. 12 is just an example and other embodiments may form, define, and/or secure chamber 200 within body portion 110 in any manner. For example, body portion 110 may define chamber 200 (i.e., chamber 200 may be integrally formed with/within body portion 110).

While the toy figurine and/or toy presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy figurine and/or toy described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A toy figurine comprising:

a body portion having an internal cavity, wherein the internal cavity includes a cap portion that is substantially aligned to a longitudinal axis of the toy figurine and a portal portion that extends at an angle from the longitudinal axis, and wherein the portal portion has a smaller cross-sectional area than a cross-sectional area of the cap portion;

a substantially transparent portal at a distal end of the portal portion through which contents of the internal cavity are viewable; and a die, wherein the internal cavity includes a fluid and the die is freely floating in the fluid, and wherein the die includes a plurality of faces, each face including a visual element.

2. The toy figurine of claim 1, wherein the portal is at angled with respect to a surface of the body portion.

3. The toy figurine of claim 1, wherein the toy figurine further includes a head portion, two arm portions, and two leg portions.

4. The toy figurine of claim 3, wherein a buoyancy of the die and a geometry of the portal portion of the internal cavity biases the die to float substantially adjacent to the portal when the toy figurine is in a position in which the head portion is substantially above the body portion.

5. The toy figurine of claim 1, wherein the die is an isohedron.

6. The toy figurine of claim 1, wherein each visual element included on the plurality of faces is selected from a group of: a word, a letter, and a number.

7. The toy figurine of claim 1, wherein each visual element included on the plurality of faces comprises an emoji.

8. The toy figurine of claim 1, wherein each visual element included on the plurality of faces comprises a particular color.

9. The toy figurine of claim 1, wherein the toy figurine comprises a humanoid figurine having an anterior and a posterior, and wherein the portal is provided on the body portion at a position corresponding to one of: the anterior of the toy figurine, and the posterior of the toy figurine.

10. The toy figurine of claim 1, wherein the fluid has a higher density than the die.

11. A toy comprising:

a body portion having an internal cavity, wherein the internal cavity includes a cap portion that is substantially aligned to a longitudinal axis of the toy and a portal portion that extends at an angle from the longitudinal axis, and wherein the portal portion has a smaller cross-sectional area than a cross-sectional area of the cap portion;

a substantially transparent portal at a distal end of the portal portion through which contents of the internal cavity are viewable; and a die, wherein the internal cavity includes a fluid and the die is freely floating in the fluid, and wherein the die includes a plurality of faces, each face including a visual element.

12. The toy of claim 11, wherein a buoyancy of the die and a geometry of the portal portion of the internal cavity biases the die to float substantially adjacent to the portal when the toy is held at an upright position.

13. The toy of claim 11, wherein the die comprises a polyhedron having a first axis and a second axis of different lengths.

14. The toy of claim 11, wherein the die is an octohedron.

15. The toy of claim 11, wherein each visual element included on the plurality of faces is selected from a group of: a word, a letter, and a number.

16. The toy of claim 11, wherein each visual element included on the plurality of faces comprises an emoji.

17. The toy of claim 11, wherein each visual element included on the plurality of faces comprises a particular color.

18. The toy of claim 11, wherein the fluid has a higher density than the die.

19. The toy of claim 11, wherein the fluid comprises an alcohol.

20. The toy of claim 11, wherein the fluid includes a dye.

* * * * *